US005897115A

United States Patent [19]

Sherry et al.

[11] Patent Number: 5,897,115

[45] Date of Patent: Apr. 27, 1999

[54] MOTIVATIONAL GAME FOR PET/DOG TRAINING

[75] Inventors: Daniel E. Sherry; Marcia L. Sherry, both of Barrington, Ill.

[73] Assignee: No Guts No Glory, Inc., Mt. Prospect, Ill.

[21] Appl. No.: 08/966,338

[22] Filed: Nov. 7, 1997

Related U.S. Application Data

[XX .
[60] Provisional application No. 60/030,710, Nov. 8, 1996.

[51] Int. Cl.[6] ..... A63F 3/00

[52] U.S. Cl. ..... 273/242

[58] Field of Search ..... 273/242, 243, 273/248, 249

[56] References Cited

U.S. PATENT DOCUMENTS 4,121,823 10/1978 McBride .
4,199,146 4/1980 Dato .
4,344,625 8/1982 Frudakis .
4,440,396 4/1984 Frudakis .
4,572,513 2/1986 Evans .
4,817,959 4/1989 Tinsley .
4,932,667 6/1990 Gorski et al. .
4,986,757 1/1991 Mueller .
5,052,692 10/1991 Gustafson .
5,150,907 9/1992 Desmarais et al. .
5,249,807 10/1993 Peterson .
5,295,834 3/1994 Saunders .

*Primary Examiner*—William E. Stoll
*Attorney, Agent, or Firm*—Lockwood, Alex, FitzGibbon & Cummings

[57] ABSTRACT

A motivational game for enhancing obedience skills of a pet is disclosed which includes a board game having a board. The board shows a start identifier and a finish identifier for the game. A marker is included which is movable between the start identifier and the finish identifier. The board game includes obedience task indicia associated with it. The obedience task indicia identifies an obedience task to be performed by the pet during play of the board game. Movement of the marker is based on performance of the obedience task by the pet.

25 Claims, 1 Drawing Sheet

MOTIVATIONAL GAME FOR PET/DOG TRAINING

CROSS-REFERENCE TO RELATED APPLICATION

This application claims the benefit of U.S. Provisional Application No. 60/030,710, filed Nov. 8, 1996.

BACKGROUND OF THE INVENTION

The present invention relates generally to motivational games and methods of playing the same. More particularly, the invention relates to motivational games and methods for assessing the pet training skills of a human and the obedience skills of a pet. Moreover, the present invention relates to motivational games for assessing the interaction between a pet owner and his pet and for comparing such interaction with the interaction between other pet owners and their respective pets.

The related art games and motivational tools, although useful for limited applications, do not achieve the benefits and advantages derived from the motivational 2game of the present invention. The related art games do not provide for a method of assessing the pet training skills of a human, the obedience skills of a pet and the interaction between a pet owner and his pet. Furthermore, the related art games and motivational tools do not provide for such a method in an entertaining board game environment.

Generally speaking, the related art games and motivational tools may be classified in two different groups. First, the related art includes motivational tools for teaching a family pet to perform obedience tasks. These related art motivational tools may also assess the obedience skills of a pet and the training skills of its owner. However, these related art motivational tools existing before the present invention do not include a board game apparatus that allows pet owners to make such assessments in a fun and entertaining environment.

Second, the related art includes board games of a general type designed to provide entertainment for their players. However, the related art board games existing before the present invention have not been directed to a game that assesses the training skills of a pet owner, the obedience skills of his pet and the interaction between that owner and his pet. In particular, it has been found that there is a direct correlation between a person's ability to communicate a command to his family pet and that pet's ability to perform the requested obedience task. Before the present invention, the related art did not include an effective way to assess interaction between a human and his pet and compare such interaction with the interaction between other humans and their respective pets in an entertaining board game environment.

The present invention overcomes these deficiencies of the related art board games and motivational tools. It is understood by those skilled in the art that the ability of a pet to respond to the commands of its owner depends on three criteria. The first of these criteria is the training skills of the owner. The training skills of a pet owner are closely related to the ability of the owner to communicate signal commands. The next of the three criteria is the obedience skills of the pet. This criteria measures the ability of the pet to understand the command signals of its owner. The final, but perhaps most important, criteria is the interaction between the owner and his pet. It is well known that some pets respond to only a select group of people, if any at all. The present invention assesses these three criteria, among other things.

In order to overcome the deficiency of the related art board games and motivational tools, it is an object of the present invention to provide a new pet-training board game which is designed to encourage pet owners to facilitate the process of training their pets.

It is another object of the present invention to provide a new pet-training board game that allows pet owners to assess the obedience skills of their pet.

It is a further object of the present invention to provide a new pet-training board game that allows pet owners to assess their own training skills.

It is yet another object of the present invention to provide a new pet-training board game that allows pet owners to assess the effectiveness of the interaction they have with their family pet.

It is still another object of the present invention to provide a new pet-training board game that allows family members, friends or acquaintances to spend enjoyable time together while they assess their ability to interact with their pets.

SUMMARY OF THE INVENTION

The present invention is directed to a motivational game for enhancing the obedience skills of a pet. The game comprises a board game having a board. One face of the board has a sheet of paper attached to it. The sheet of paper has a start identifier and finish identifier imprinted on it. A marker is included for the board game and may be moved between the start identifier and the finish identifier. The board game includes obedience task indicia associated therewith. The obedience task indicia identify an obedience task to be performed by the pet during play of the board game. Movement of the marker is based on performance of the obedience task by the pet. For instance, if the pet successfully performs the obedience task, a team may move its marker closer to the finish identifier.

The present invention is also directed to a method of enhancing the obedience skills of a pet by utilizing a board game similar to that described above. The method comprises the steps of selecting an obedience task from a plurality of obedience tasks associated with the board game, identifying the obedience task, commanding the pet to perform the selected obedience task, and moving the marker along a playing path defined on the board according to performance of the selected obedience task by the pet.

BRIEF DESCRIPTION OF THE DRAWINGS

The features of the present invention which are believed to be novel are set forth with particularity in the appended claims. The invention, together with the further objects and advantages thereof may best be understood by reference to the following detailed description taken in conjunction with the accompanying drawing, in which

DETAILED DESCRIPTION OF THE DRAWINGS

Figure 1:
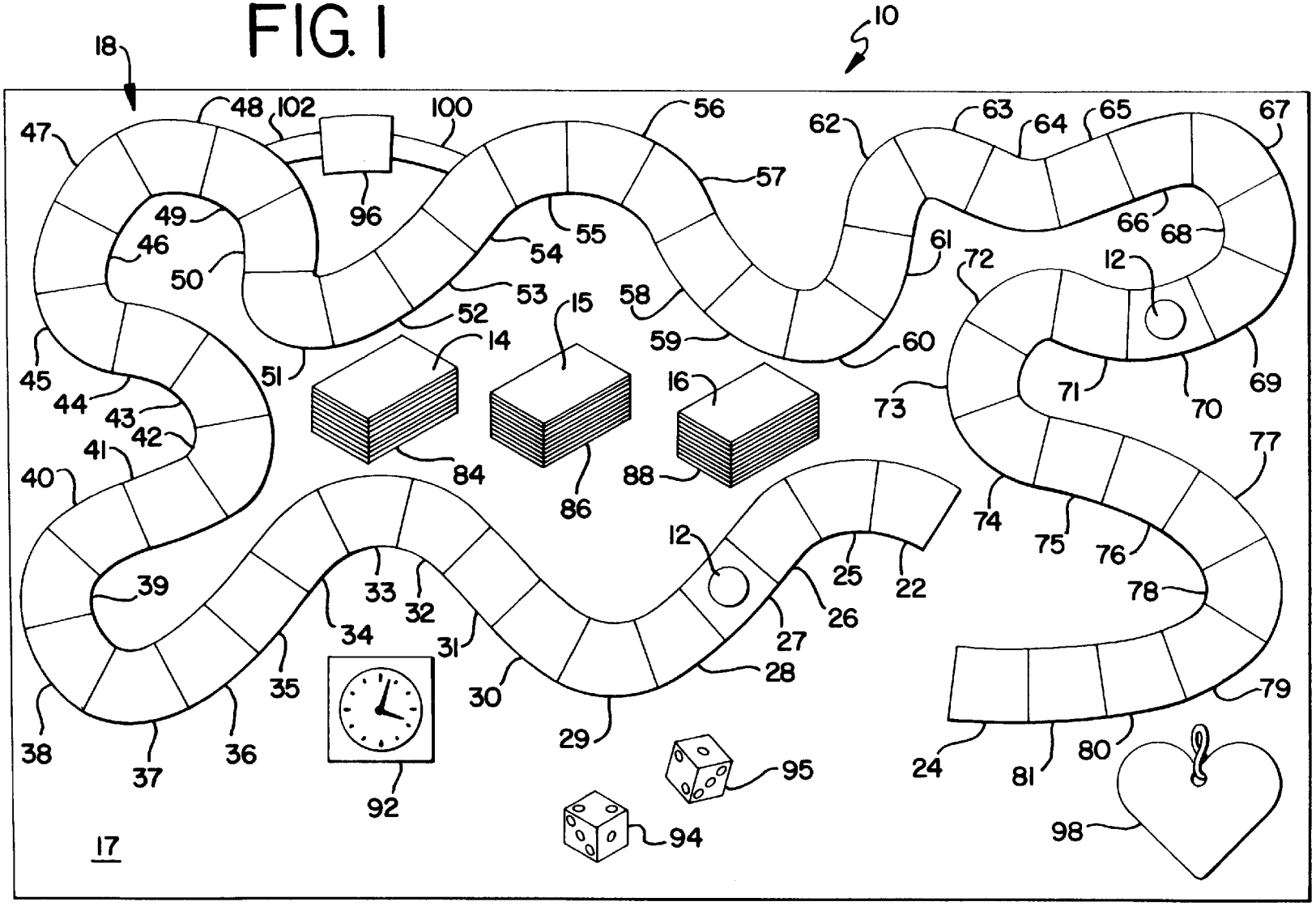
FIG. 1 is a top view of one embodiment of the board game of the present invention showing, among other things, team markers and obedience task selection cards thereon.

Referring to FIG. 1, an embodiment of this invention is illustrated which includes, among other things, a game board apparatus 10, team markers 12 and a plurality of card stacks 14, 15 and 16.

Game board apparatus 10 may be made in the conventional manner well known in the art wherein it comprises a rectangular-shaped piece of cardboard that provides a rigid backing for the board. The cardboard backing will typically have a sheet of paper 17 glued or otherwise attached to one face thereof.

A generally serpentine path 18 is imprinted on the sheet of paper 17 to define a playing route for the game of the present invention. Serpentine path 18 may be defined by a plurality of playing spaces which extend from a start space 22 to a finish space 24 along the playing route. A plurality of intermediate playing spaces identified as reference numerals 25–81 are also shown. Intermediate spaces 25–81 define contiguous spaces that connect start space 22 with finish space 24 along the playing route of serpentine path 18.

In a preferred embodiment of the invention, comments and/or directions may be imprinted within the outline of the spaces 22–81. Such comments and/or directions would preferably further help to enhance the marketability of a commercial embodiment of the invention. It is to be appreciated that the teams will follow any direction imprinted within spaces 22–81 upon landing their marker 12 on such spaces during play of the game. In the preferred embodiment of the invention, the spaces 22–81 will have directions and/or comments imprinted therein as identified in Table 1 set forth on pages 19 and 20 hereof.

Any imaginable drawing may be imprinted on the remainder of the sheet of paper 17. Those skilled in the art will appreciate that the chosen drawing would preferably further help to enhance the marketability of a commercial embodiment of the present invention.

It will further be appreciated by those skilled in the art that the serpentine path 18 may assume forms or shapes other than the form illustrated in FIG. 1 without departing from the spirit and scope of the appended claims. It will likewise be appreciated that team markers 12 may embody any size or shape, but they will preferably fit within the outline of each space and they will preferably be movable from one space to another by the players of the board game.

Three card placement spaces 84, 86 and 88 are also imprinted on the sheet of paper 17 attached to one side of the cardboard backing of board game 10. In the preferred embodiment of the invention, the three stacks of cards 14, 15 and 16 may each be placed within their respective card placement spaces 84, 86 and 88 imprinted on sheet 17.

The cards in each stack 14, 15 and 16 preferably include one face having imprinted thereon a skill level identifier. The skill level identifiers will typically identify the difficulty of the obedience task to be performed by the pet during play of the game. In one embodiment of the present invention, the skill level identifiers may be "Beginner" (for simple obedience tasks), "Intermediate" (for more difficult obedience tasks) and "Advanced" (for the most difficult obedience tasks). Each stack of cards will preferably comprise cards having a specific skill identifier. In other words, stack 14 may comprise only "Beginner" cards, stack 15 may comprise only "Intermediate" cards, and stack 16 may comprise only "Advanced" cards.

The cards in each stack further include a back face having imprinted thereon obedience task indicia and a point value identifier. The obedience task indicia will set forth the obedience tasks that the players on a given team will attempt to command their team's pet to perform when it is their team's turn to play. In a preferred method of play, if a team is successful at commanding the pet to perform the identified obedience task, the point value identifier determines how many spaces closer to finish space 24 the team may move its marker 12 along the playing route of serpentine path 18.

In one such preferred method of play, a successful team would move its marker a total number of spaces equivalent to the point value identified on the second face of the drawn card. This, however, is certainly not a mandatory rule of the game. Other preferred methods of playing board game 10 may include different rules for determining the number of spaces the team would move its marker if it is successful at commanding its pet to perform the obedience task. For example, the movement of the markers for each team might be based alternatively on a handicap system. This handicap system may be independent of or correlated to the point value identified on the face of the drawn card and may be defined to take into account the training skill levels of the teams, for example.

Again, the point values identified on each card preferably are predetermined based on the skill level required to command the pet to perform the obedience task also identified. In a preferred embodiment, the stack of "Beginner" skill level cards may have point values ranging from one to five spaces, assuming that the rules of the game are established so that each team is to move its marker one space for each point that team accumulates. The stack of "Intermediate" skill level cards may have point values ranging from five to nine spaces. And the stack of "Advanced" skill level cards may have point values ranging from nine to twelve spaces. In any event, the point value identified on each card is preferably proportional to the difficulty of the obedience task also identified on the card. In other words, cards from a stack requiring the animal to perform a more difficult obedience task, such as the stack 16 of "Advanced" cards, will preferably have a higher point value than those cards from a stack requiring the animal to perform relatively easy obedience tasks, such as the stack 14 of "Beginner" card.

It will be appreciated by those skilled in the art that the selection apparatus used to select the obedience tasks that each team will command its pet to perform may include any device or apparatus capable of allowing the players to randomly select such obedience task. For example, the stacks of cards 14, 15 and 16 shown in the preferred embodiment could quite easily be replaced with a spinner or similar device well known in the pertinent art. Furthermore, point values for the tasks could be established by other means, such as the roll of a die. Other arrangements and combinations could similarly be used.

In addition to the elements identified above, the board game 10 may include a timing device 92 and two dice 94, 95 (see FIG. 2). Die 95 is included merely as a replacement die in case die 94 is lost or misplaced. The reason for including timer 92 and die 94 with the preferred embodiment of the present invention will become apparent in light of the discussion below.

The preferred method of playing the embodiment of the invention illustrated in FIG. 1 follows. First, the teams that will play the game should be established. Only one person and one dog are necessary to play the game of the present invention. For instance, the teams of the game may share a single pet to play the game. Under such circumstances, the training skills of the players will be assessed and compared through play of the game. Alternatively, one team may use several pets to play the game. Under such circumstances, the obedience skills of the different pets will be assessed and compared through play of the game. However, it will be appreciated that other team arrangements are available, including the use of more than one pet and/or the use of more than one person on a particular team. The number of players and the number of pets able to play the game is virtually unrestricted. However, it has been found that the use of more than four players and/or the use of more than four pets might reduce the enjoyment rendered through play of the game.

For simplicity of discussion, this description will assume that two players and their respective pets are playing the game. Each player comprises his own team and utilizes his own pet to attempt to move his team marker 12 along the serpentine path 18 towards finish space 24.

After the teams have been established, the teams then choose their markers 12 from a pool of markers available for playing the game. In a preferred method of play, each team compares its total training skill level with the total training skill level of the opposing teams. If the players on one team are much more experienced at training pets than the players on an opposing team, the team comprising the advanced trainers should "spot" the opposing team by starting behind them.

Assume for the moment that the player identified as being on the first team has a much greater level of training experience than the player on the second team. The player on the second team will preferably have the option of beginning play by setting his marker on a predetermined intermediate space, such as intermediate space 30, while the advanced player will preferably begin play of the game from start space 20. This feature of the present invention amounts to a handicap system that compensates for the distinguishing levels of total training experience between teams. As a result, play of the game becomes more competitive.

It will be appreciated by those skilled in the art that additional features to this handicap system may be made without departing from the true scope thereof. For instance, the handicap system may permit a team having players of low training experience to place its marker 12 on an intermediate space even closer to finish space 24 than the intermediate space identified above. Furthermore, the handicap system may comprise features which account for varying levels of training experience such as advanced, intermediate and beginner levels. It will be appreciated that in this instance, the teams may begin play at a plurality of different spaces. A team having players comprising the lowest total training experience will preferably begin play at an intermediate space closer to finish space 24 than any of its opposing teams. In any event, it will be appreciated that the aforementioned handicap system is an optional feature of the present invention.

After choosing the team markers 12 and setting them within a space along the playing route, the teams then sort the cards into their respective stacks 14, 15 and 16 of distinguishing obedience task skill levels. As earlier described, the cards are preferably arranged in stacks of beginner, intermediate and advanced trick levels. The cards are then shuffled and are placed on their respective card placement spaces 84, 86 and 88 imprinted on sheet 17 attached to one face of board game 10.

The players then determine which team will begin play. One member of each team rolls die 94. Typically, the team whose member rolls the highest value on the die will begin play. Thereafter, other teams take turns playing the game according to how they are arranged or seated in relation to the board. In most circumstances, the sequence of play continues in a clockwise direction. Nevertheless, it will be appreciated by those skilled in the art that the determination of which team will begin play and the determination of how the sequence of play will continue are described in this description for exemplary purposes only. Therefore, these matters are not meant to constitute limitations of the appended claims.

Each team begins its turn by having one of its players draw a card from any of the card stacks 14, 15 or 16 placed within card placement spaces 84, 86 and 88 imprinted on board 10. The player drawing the card preferably reads the entire card aloud, including those portions identifying the obedience task that the team will attempt to command its pet to perform. The player also preferably reads aloud the point value that will be awarded to his team if the pet performs that obedience task when commanded to do so by the team.

It will be appreciated that the drawn card might additionally include language imprinted on the back face thereof that indicates how the team must command its pet to perform the obedience task, a command method indicator. For instance, the drawn card may indicate that the team must command its pet to "sit" by pointing towards the ground. Under these circumstances, the team's act of pointing towards the ground constitutes the command signal. Thus, if the pet sits when the team issues that command, the pet will have successfully performed the identified obedience task.

After a card is drawn and read aloud, the timer 90 is then set and play for the team begins. The players on the playing team are preferably not permitted to communicate with each other before the timer has been set. Once the timer begins to run, the players on the playing team interact with the pet and attempt to command the pet to perform the obedience task identified on the drawn card. If the pet performs the identified obedience task, the team may move its marker 12 along the serpentine path 18 according to the predetermined rules of the game which may, for example, state that the team may move its marker a total number of spaces equal to the point value identified on the drawn card.

If, however, timer 92 tolls before the pet performs the obedience task, the team's turn is over and the next team may take its turn according to the predetermined sequence of play.

If the teams cannot reach agreement as to whether the pet successfully performed the identified obedience task, a method of resolving such agreement may be performed. For instance, a member of the playing team may roll die 94. If a one, two or three is rolled, play will resume as if the pet performed the obedience task. If a four, five or six is rolled, play will resume as if the pet did not perform the obedience task. It will be understood that this method of resolving a dispute is described for exemplary purposes only.

In a preferred method of play for the present invention, the timer 92 will toll after thirty seconds. However, it will be appreciated by those skilled in the art that the timer may be set to toll after any given length of time. Furthermore, it will be appreciated by those skilled in the art that the use of a timer with the present invention is optional.

In another preferred method of play, if the playing team is unsuccessful at its attempt to command the pet to perform the obedience task identified on the drawn card, the next playing team may elect to "replay" that card. In other words, the next playing team may attempt to command its pet to perform the obedience task identified on the previously drawn card rather than draw a card of its own. As an additional option, if the next playing team is able to command its pet to perform that obedience task, that team may move its marker 12 a total number of spaces doubling the point value indicated on the face of the card drawn by the original playing team. This feature of the present invention provides an incentive for the players on an opposing team to show that their level of training skill exceeds the level of training skill of the players on the original playing team.

An additional feature of the present invention includes a "shelter space" 96 imprinted on sheet 17. Shelter space 96 defines a penalty area for the teams during their play of the game. For instance, during the play of the game, a team may be commanded to "Go to the shelter!". This command may be directed to a team in a variety of ways. For instance, a team may land on an intermediate space having such a command imprinted within that space. A team directed to place its marker on shelter space 96 preferably will not be permitted to exit the shelter space without complying with predetermined rules.

For example, it may be predetermined by the rules of the game that a team may only exit shelter space 96 by rolling a six on die 94. Under such circumstances, a player of the team will roll the die each time it is his team's turn to play. Similarly, it may be predetermined by the rules of the game that a team having its marker 12 within shelter space 96 may leave the shelter only after each of its opposing teams have had three turns of play. Other variations, such as a combination of the two exemplary rules above, may be equally effective.

An additional feature of the present invention includes an identification tag 98 which may be used during play of the game. The ID tag 98 permits the team possessing it to immediately exit shelter space 96 at any time and/or to exit the shelter space along special path 100 to intermediate space 54, when that team is permitted to exit the shelter space, according to the predetermined rules of the game. The ID tag 98 is acquired by a team when that team's marker lands on a space or draws a card identifying that the team may acquire the tag. This method of acquiring the tag is described for exemplary purposes only, as it will be appreciated that alternative methods would also suffice.

If only one ID tag is used during play of the game, the ID tag preferably will pass from one team to another as the teams subsequently acquire rightful possession to it. On the other hand, if more than one ID tag 98 is used during play of the game, each team may acquire an ID tag of its own and obtain the benefits derived therefrom.

In any event, possession of an ID tag permits a team to (1) exit shelter space 96 immediately; (2) exit the shelter space along special path 100 to intermediate space 54, rather than exit the shelter space along ordinary path 102 to intermediate space 49 (as the team would be required to do if it did not possess an ID tag); or (3) a combination of (1) and (2) above. It will be appreciated by those skilled in the art that alternative methods of play based on use of the ID tags of the invention exist and that alternative structures other than ID tag 98 may be used with the present invention.

Play continues for each team until one team has moved its marker 12 from its beginning space, which may be start space 22, along serpentine path 18 to the finish space 24. That team will then be declared the winner of the game.

It is contemplated that the rules of the game may or may not require the winning team to land its marker 12 exactly on finish space 24. If such an exact landing is required, a team may only attempt to command its pet to perform the identified obedience task if the point value indicated on a drawn card is equal to or less than the total number of spaces its marker rests from finish space 24, assuming the rules of the game allow the teams to move their markers one space for each point they accumulate.

It should be apparent from the foregoing description that the present invention encourages pet owners to train their pets even when they are not playing the game. Doing so will improve their chances of winning the game.

Although the present invention has been described with reference to a certain preferred embodiment, modifications or changes may be made therein by those skilled in the art without departing from the scope and spirit of the invention as defined by the appended claims.

TABLE 1

| SPACE NO. | DIRECTION/COMMENT |
|---|---|
| 22 | BEST TRAINERS START HERE |
| 24 | WOW! TAKE A BOW! STUNT MASTER! KING OF HOLLYWOOD |
| 25 | FIRST VET VISIT! I'M YOUR BEST FRIEND |
| 27 | YOU WERE VERY SOCIAL AT YOUR VET'S PUPPY PARTY |
| 29 | OOPS! AN ACCIDENT ON THE ORIENTAL! GO BACK 3 SPACES |
| 30 | BETTER TRAINERS START HERE |
| 31 | PET STORE CHEW TOYS ARE BETTER THAN FURNITURE! GO FORWARD 3 SPACES |
| 33 | PET STORE . . . YOU NEED MORE TRAINING TREATS |
| 35 | BAD OWNER . . . YOU LOST YOUR PATIENCE . . . LOSE YOUR TURN |
| 36 | GOOD TRAINERS START HERE |
| 37 | EXCELLENT! YOU WENT POTTY OUTSIDE . . . GO FORWARD 3 SPACES |
| 39 | MY OWNER LEARNED AS MUCH AS I DID AT SCHOOL! |
| 41 | GRADUATED PUPPY CLASS WITH HONORS! GO FORWARD 3 SPACES |
| 43 | GROOMERS! WELL AREN'T YOU THE CAT'S MEOW! |
| 45 | YOU'RE DISCOVERED DOING TRICKS ON LATE NIGHT T.V.! GO FORWARD 3 SPACES |
| 47 | YOU WON! WAGGIEST TAIL CONTEST! GO FORWARD 3 SPACES |
| 49 | YOU WERE FOUND ACROSS TOWN! GO TO THE SHELTER |
| 51 | THANK YOU! FOR ATTENDING THE SHELTER'S FREE SPACE/NEUTER CLINIC . . . GO AGAIN |
| 53 | VETERINARIAN . . . YOU'RE LUCKY! NEXT TIME COME WHEN YOU'RE CALLED |
| 54 | EXIT FOR PERSONALIZED I.D. TAG OWNERS ONLY |
| 55 | AN AGENT! YOU'RE ON YOUR WAY NOW |
| 57 | LOOK AT YOU! SHOWING OFF IN INTERMEDIATE TRAINING! |
| 59 | EXTRA! EXTRA! YOUR AGENT CASTS YOU AS AN EXTRA! |
| 61 | LOST! GO TO SHELTER IF YOU DO NOT HAVE A PERSONALIZED I.D. TAG |
| 63 | YOU'RE ON THE COVER OF DOG FANTASIES! |
| 65 | REAL DOGS EXERCISE IN A REAL DOG PARK! |
| 67 | ADVANCED TRAINING! YOU ARE SO WELL BEHAVED! |
| 69 | YOU'RE THE NEW NATIONAL AGILITY CHAMPION! GO FORWARD 3 SPACES |
| 71 | WOOF WOOF . . . A SPEAKING PART! DON'T FORGET YOUR LINES! |
| 73 | CAREFUL! YOU'LL BE TYPECAST IF ALL YOU CAN DO IS THE DOG PADDLE! |
| 75 | DOGGIE WALK-A-THON . . . YOU RAISED MONEY FOR SERVICE DOG TRAINING! GO FORWARD 3 SPACES |
| 77 | YOU DID IT! YOU ARE THE ALPHA ACTOR IN A HIT MOVIE! |
| 79 | GOTCHA! PAPARAZZI CATCH YOU WHERE YOU SHOULDN'T BE! GO BACK 3 SPACES |
| 81 | IMPRESSIVE! YOU DO YOUR OWN STUNTS IN THE REMAKE OF CITIZEN CANINE! |

We claim:

1. A motivational game for enhancing obedience skills of a pet, comprising:

a board game having a board;

said board showing a start identifier and a finish identifier;

a marker movable between said start identifier and said finish identifier;

said board game including a selection apparatus identifying obedience task indicia;

said obedience task indicia identifying an obedience task to be performed during play of said board game; and movement of said marker being based on performance of said obedience task by a pet.

2. A motivational game as defined in claim 1 wherein said obedience task indicia is imprinted on said selection apparatus.

3. A motivational game as defined in claim 2 wherein said selection apparatus comprises a plurality of cards.

4. A motivational game as defined in claim 3 wherein said plurality of cards includes at least two sets of said plurality of cards distinguished by a skill level identifier printed on one face of said cards.

5. A motivational game as defined in claim 1 wherein said marker is moved towards said finish identifier if said pet successfully performs said obedience task identified by said obedience task indicia.

6. A motivational game as defined in claim 1 wherein said start identifier and said finish identifier are both shown on one face of said board.

7. A motivational game as defined in claim 6 wherein a sheet of paper is attached to said one face of said board and said start identifier and said finish identifier are imprinted on said sheet of paper.

8. A motivational game as defined in claim 7 wherein said start identifier comprises a start space and said finish identifier comprises a finish space.

9. A motivational game as defined in claim 8 further comprising a plurality of intermediate spaces imprinted on said sheet of paper in a manner such that said intermediate spaces are contiguously connected between said start space and said finish space.

10. A motivational game as defined in claim 9 wherein said start space, said finish space and said plurality of intermediate spaces together define a playing path for said board game and form a serpentine-like shape.

11. A method of enhancing obedience skills of a pet by utilizing a board game having a board and a marker comprising the steps of:

selecting an obedience task from a plurality of obedience tasks associated with said board game;

identifying said obedience task;

commanding said pet to perform the selected obedience task; and moving said marker along a playing path defined on said board according to performance of the selected obedience task by the pet.

12. The method as defined in claim 11 wherein said marker is moved along said playing path if said pet successfully performs said obedience task.

13. The method as defined in claim 11 wherein said obedience task is selected by drawing a card from a plurality of cards, said drawn card having an obedience task indicia imprinted on at least one of its faces.

14. The method as defined in claim 11 further comprising the step of selecting a method for commanding said pet to perform said obedience task.

15. The method as defined in claim 14 wherein said method of commanding said pet to perform said obedience task is selected by drawing a card from a plurality of cards, said drawn card having a method of command indicia imprinted on at least one of its faces.

16. The method as defined in claim 11 further comprising the step of initiating a timer after identifying said obedience task.

17. The method as defined in claim 16 further comprising the step of deciding said pet failed to perform said obedience task if said timer tolls before said pet successfully performs said selected obedience task.

18. The method as defined in claim 11 further comprising the step of selecting a trick value to determine the movement of said marker along said playing path according to performance of said selected obedience task by the pet.

19. The method as defined in claim 18 wherein said marker is moved along said playing path a number of spaces equal to said trick value according to performance of said selected obedience task by the pet.

20. The method of as defined in claim 19 wherein said marker is moved along said playing path a number of spaces equal to said trick value if said pet successfully performs said selected obedience task.

21. The method as defined in claim 11 further comprising the step of providing a handicap system for play of said board game.

22. A motivational game for enhancing obedience skills of a pet, comprising:

a display showing a start identifier and a finish identifier;

an indicator displayable on said display;

a selection apparatus identifying obedience task indicia;

said obedience task indicia identifying an obedience task to be performed during play of said game; and display of said indicator being based on performance of said obedience task by a pet.

23. A motivational game as defined in claim 22 wherein said start identifier comprises a start space and said finish identifier comprises a finish space.

24. A motivational game as defined in claim 23 further comprising a plurality of intermediate spaces displayed on said display in a manner such that said intermediate spaces appear generally contiguously connected between said start space and said finish space.

25. A method of enhancing obedience skills of a pet by utilizing a motivational game having a display and an indicator, comprising the steps of:

selecting an obedience task from a plurality of obedience tasks associated with said motivational game;

identifying the selected obedience task;

commanding a pet to perform the selected obedience task; and displaying said indicator along a playing path defined on said display according to performance of the selected obedience task.

* * * * *